US005811936A

United States Patent [19]

Turner et al.

[11] Patent Number: 5,811,936

[45] Date of Patent: Sep. 22, 1998

[54] ONE PIECE MICROWAVE CONTAINER SCREENS FOR ELECTRODELESS LAMPS

[75] Inventors: Brian Turner, Myersville; Michael Ury, Bethesda, both of Md.

[73] Assignee: Fusion Lighting, Inc., Rockville, Md.

[21] Appl. No.: 592,474

[22] Filed: Jan. 26, 1996

[51] Int. Cl.[6] ..... H01J 65/04

[52] U.S. Cl. ..... 315/39; 315/248

[58] Field of Search ..... 315/39, 298, 267, 315/344; 313/113; 362/341, 343, 396

[56] References Cited

U.S. PATENT DOCUMENTS

| | | | |
|---|---|---|---|
| 4,673,846 | 6/1987 | Yoshizawa et al. | 315/248 |
| 4,695,694 | 9/1987 | Hill et al. | 315/39 X |
| 4,954,755 | 9/1990 | Lynch et al. | 315/248 |
| 5,227,698 | 7/1993 | Simpson et al. | 315/248 |
| 5,334,913 | 8/1994 | Ury et al. | 315/248 |
| 5,404,076 | 4/1995 | Dolan et al. | 313/572 |

FOREIGN PATENT DOCUMENTS 0153745 5/1991 European Pat. Off. .

*Primary Examiner*—Benny T. Lee

*Attorney, Agent, or Firm*—Epstein, Edell and Retzer

[57] ABSTRACT

A microwave powered electrodeless lamp includes an improved screen unit having mesh and solid sections with an internal reflector to reflect light into a light-transmitting chamber defined in the lamp microwave cavity by the reflector and the mesh section. A discharge envelope of a bulb is disposed in the light-transmitting chamber. Light emitted from the envelope is prevented by the reflector from entering the cavity portion bounded by the solid section of the screen. Replacing mesh material by solid metal material as part of the screen unit significantly reduces leakage of microwave energy from the lamp. The solid section has multiple compliant fingers defined therein for engaging the periphery of a flange on the waveguide unit so that a hose clamp can easily secure the screen to the assembly. Screen units of this type having different mesh section configurations can be interchanged in the lamp assembly to produce different respective illumination patterns.

20 Claims, 5 Drawing Sheets

ONE PIECE MICROWAVE CONTAINER SCREENS FOR ELECTRODELESS LAMPS

BACKGROUND OF THE INVENTION

1. Technical Field

The present invention pertains generally to microwave powered electrodeless lamps and, more specifically, to improvements in screen structures used in such lamps to block escape of microwave energy while permitting transmission of light.

2. Discussion of the Prior Art

Lamps utilizing radio frequency (RF) energy to excite electrodeless bulbs are well known. Examples of such lamps may be found in U.S. Pat. Nos. 4,954,755 (Lynch et al), 5,227,698 (Simpson et al), 5,334,913 (Ury et al) and 5,404,076 (Dolan et al). The disclosures in all of these patents are expressly incorporated by reference herein. In lamps of this type microwave energy is coupled from a magnetron or other RF source to the lamp bulb via a coupling circuit including a waveguide and a quasi-resonant cavity typically defined, at least in part, by a screen unit. The waveguide functions as an impedance matching device from the source to the cavity.

Prior art screen structures used in microwave powered lamps are disclosed in numerous prior patents as represented by the above-mentioned Lynch et al, Simpson et al, Ury et al and Dolan et al patents, and in European Patent Specification 0 153 745 (Yoshizawa et al). Such screens typically surround a bulb envelope and serve to allow optical radiation from the bulb to escape while forming a conductive enclosure blocking escape of RF energy. Screen design has generally involved an inherent compromise between these factors. Specifically, screens having very low optical loss tend to permit escape of undesirably large amounts of RF radiation. On the other hand, elimination of RF radiation generally incurs the penalty of diminishing optical transmission through the screen.

In addition, in many prior art screens, a metallic ring is attached to the screen base so that the ring can be fastened to the waveguide. The inclusion of the ring as part of the screen adds significant expense to screen fabrication.

Further, in producing a lamp product line, it is often desirable to minimize the cost involved in permitting different optical configurations for different models of lamps. In other words, a manufacturer would prefer to utilize as many common components as possible from model to model. Where components must be changed, ideally they are inexpensive components. It is advantageous, therefore, to provide a screen design that is inexpensive and configured so that the expensive components of a lamp assembly can remain common to various lamp models having different optical characteristics.

OBJECTS AND SUMMARY OF THE INVENTION

Accordingly, it is an object of the present invention to provide an inexpensive screen enclosure for microwave powered electrodeless lamps wherein optical transmission and radio frequency blockage are optimized.

It is another object of the present invention to provide a screen enclosure for a microwave powered lamp that is inexpensive to fabricate yet easily and inexpensively secured to a waveguide.

In accordance with the present invention, a screen structure for a microwave powered electrodeless lamp includes a metal mesh section and a solid metal section. The mesh section is transmissive to light and non-transmissive to microwave energy at the operating frequency. The solid section is non-transmissive to both light and the microwave energy. In this regard, the term "solid" as used herein is intended to distinguish from the mesh section and connotes the absence of gaps or breaks in the structure.

In the preferred embodiment the mesh section has a right cylindrical configuration with a mesh end cap at one end thereof, and the solid section is configured as a right cylindrical section of like diameter extending coaxially from the opposite end of the mesh section. A reflector, in the form of an electrically non-conductive circular disk, has its annular edge secured at the annular juncture between the mesh and the solid sections, and is disposed coaxially with both the mesh section and the solid section with the reflector's reflective surface facing into the mesh section. The reflector thus defines an optically isolated light transmission chamber within the microwave cavity. An electrodeless bulb has its discharge envelope disposed within the light transmitting cavity surrounded by the mesh section. The reflector is centrally apertured to permit passage of the bulb stem through the space bounded by the solid section of the screen unit.

In its preferred form the screen unit is fabricated from two members. A first member comprises a single thin rectangular sheet of metal, preferably stainless steel, that is etched or otherwise formed to provide the mesh and solid sections therein. The mesh section is bounded along its exterior edges by a narrow solid border, formed as a continuance of the solid section, to facilitate assembly. The second member is a circular metal mesh piece circumferentially bounded by a narrow solid border. In assembling the two pieces to form the screen unit, the rectangular sheet is first rolled into a right circular cylinder such that opposite edges of the sheet are joined. These edges, including the solid border portions of the mesh section, are sealed together by suitable adhesive, welding, or other bonding technique. The second member is then secured as an end cap to the mesh section of the cylinder by adhering together the solid borders at abutting edges of the two members.

The rectangular sheet comprising the first member preferably has a plurality of spaced slots defined inwardly from the edge of the sheet opposite the mesh section. These slots define "fingers" therebetween, the fingers being sufficiently compliant to allow for a small deformation of the edge of the screen unit that attaches to the waveguide. Specifically, these fingers are defined along the annular proximal edge of the screen unit that attaches to the waveguide. An annular clamp, similar to a hose clamp, is used to secure the fingers in place about the waveguide opening.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DESCRIPTION OF THE PREFERRED EMBODIMENTS

Figure 1:
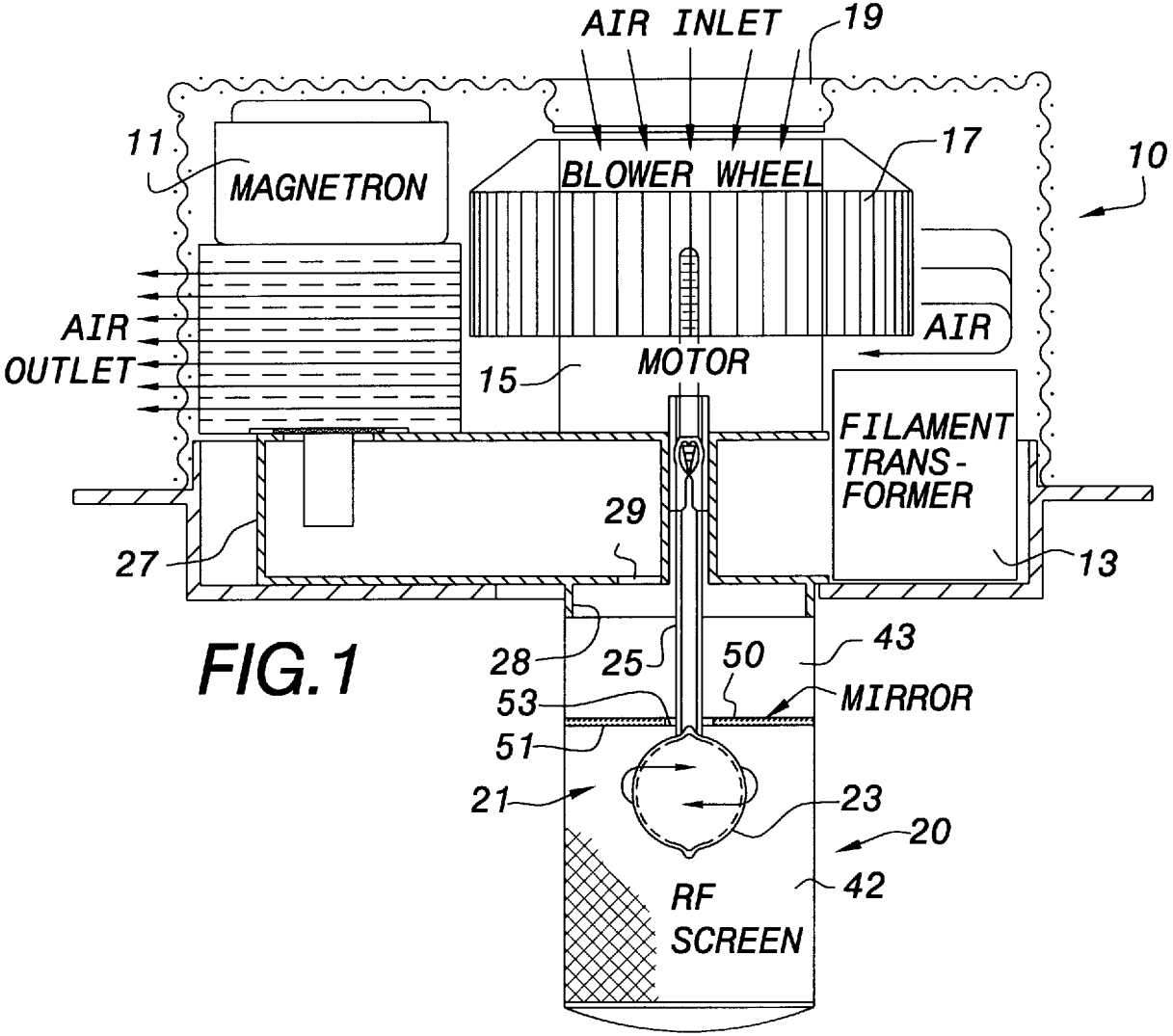
FIG. 1 is a partially diagrammatic view in longitudinal section of a lamp assembly employing a screen unit according to the principles of the present invention.

Referring specifically to FIG. 1, a lamp assembly using the screen unit of the present invention includes a lamp module 10 comprising a housing for a magnetron 11 or other microwave source, a filament transformer 13 supplying filament current to the magnetron 11, and a motor 15 for rotating a bulb and for driving a cooling fan in the form of blower wheel 17. An air inlet 19 for fan blower wheel 17 is defined in one end of the housing, and blower wheel 17 causes air to flow through the lamp module 10 to an air outlet, as shown in FIG. 1.

A screen assembly 20 defines a microwave cavity wherein a bulb 21 is disposed. Bulb 21 includes a generally spherical discharge envelope 23 supported at the end of an elongate cylindrical stem 25. Stem 25 is secured to a drive shaft of a motor 15 to permit the bulb 21 to be rotated about the longitudinal axis of its stem 25. Bulb 21 has a fill material contained in its discharge envelope 23 such as, for example, the material described in the above-referenced Dolan et al patent. The bulb is made of quartz or other suitable material.

Microwave energy generated by magnetron 11 is fed by a waveguide 27 to a coupling slot 29 providing ingress to the microwave cavity defined by screen unit 20.

Figure 2:
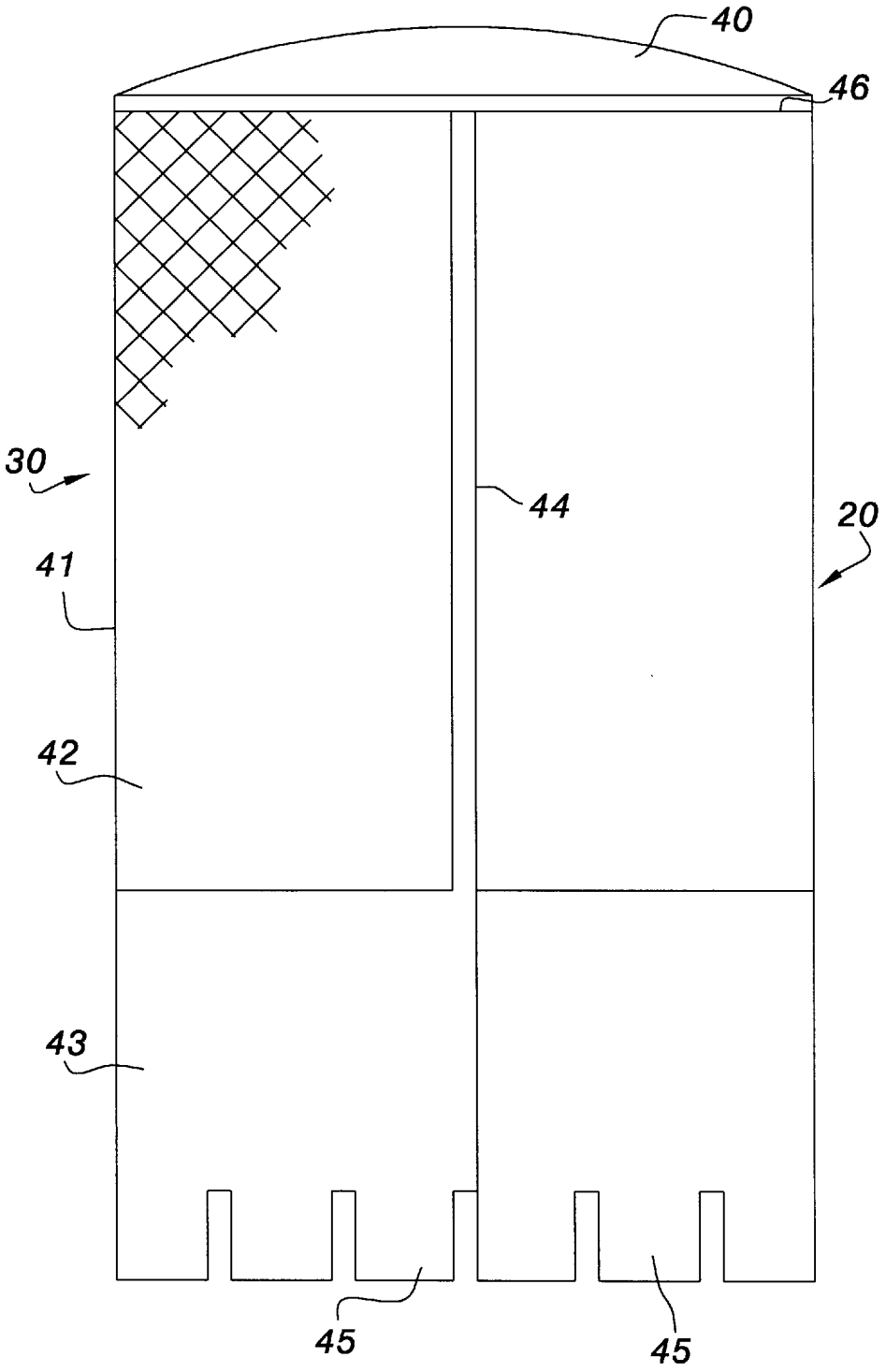
FIG. 2 is a side view in elevation of the screen unit used in the assembly of FIG. 1.
Figure 5:
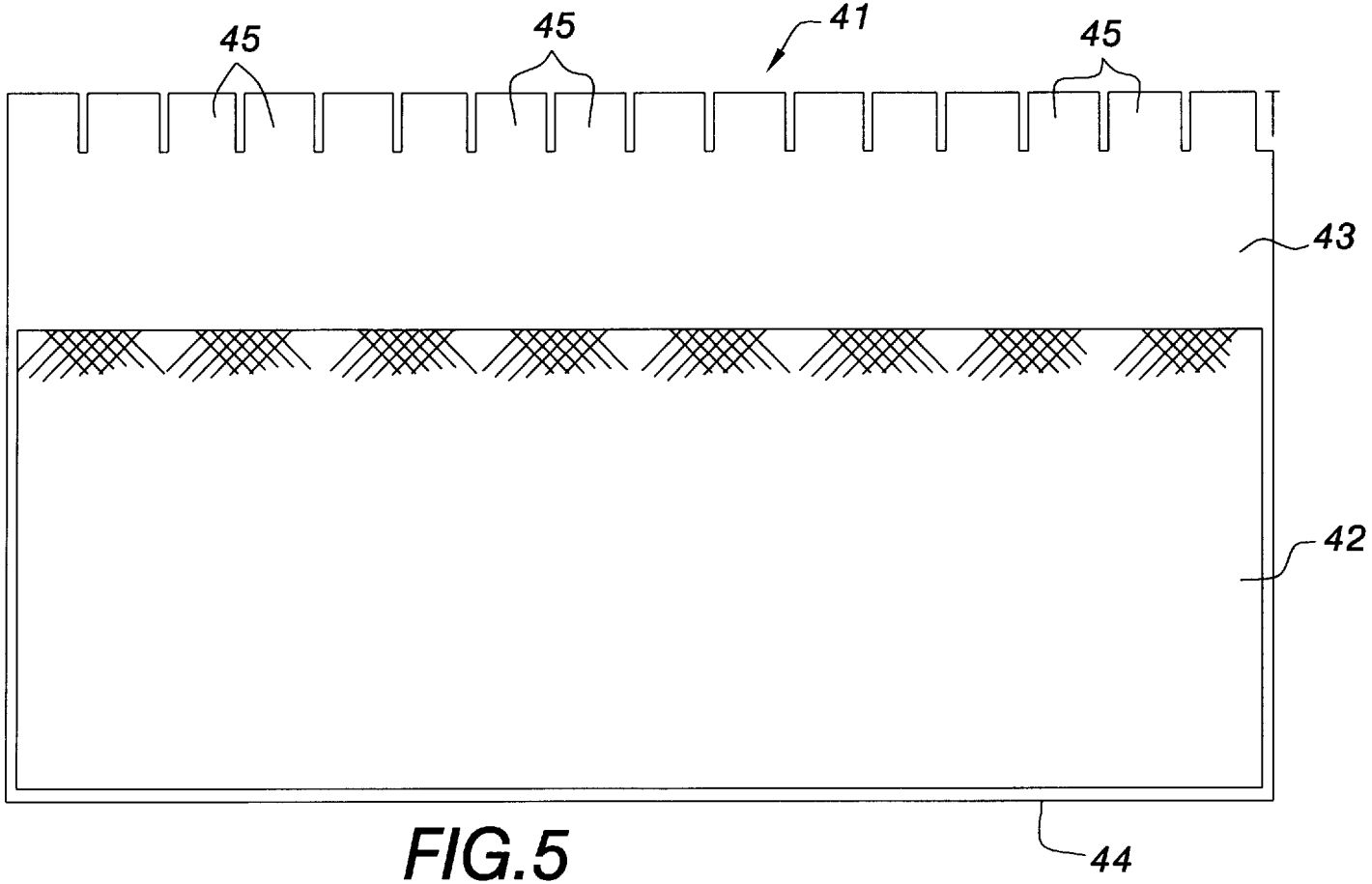
FIG. 5 is a top view in plan of an etched metal sheet used to form the screen assembly of FIG. 2.

The screen unit 20 of the preferred embodiment is made from two members, namely a right cylindrical member 30 and an end cap 40 (see FIG. 2). Each of these two members is formed as a respective one-piece unit. Specifically, cylindrical member 30 is formed from a single sheet 41 (see FIG. 5) of metal that has been etched to provide a metal mesh section 42 and a metal solid section 43. Preferably, sheet 41 is a stainless steel sheet having a thickness between 0.003 and 0.005 inches. Mesh section 42 is etched through the sheet, the etching pattern preferably being controlled by computer so that virtually any location of the mesh section or sections and any pattern and size of the interstices of the mesh can be provided. The size and pattern of the interstices are selected to minimize transmission of RF energy through the conductive mesh. As shown in FIG. 5, in the preferred embodiment mesh section 42 (also denoted by "RFSCREEN" in FIG. 1) and solid section 43 are formed in sheet 41 as adjacent rectangular sections meeting at a straight line juncture corresponding to the abutting inboard edges of these two sections. The three outer edges of mesh section 42 are bounded by a very narrow solid metal border or strip 44 formed as a continuance of solid metal section 43. The longer outer edge of solid section 43 has multiple slots etched therethrough and extending perpendicular to that edge toward mesh section 42. These slots define multiple finger-like members 45 which, because of the thinness of the material of sheet 41 and the spacing of the slots, are individually compliant to facilitate attachment of the screen unit to the assembly in the manner described below.

Figure 3:
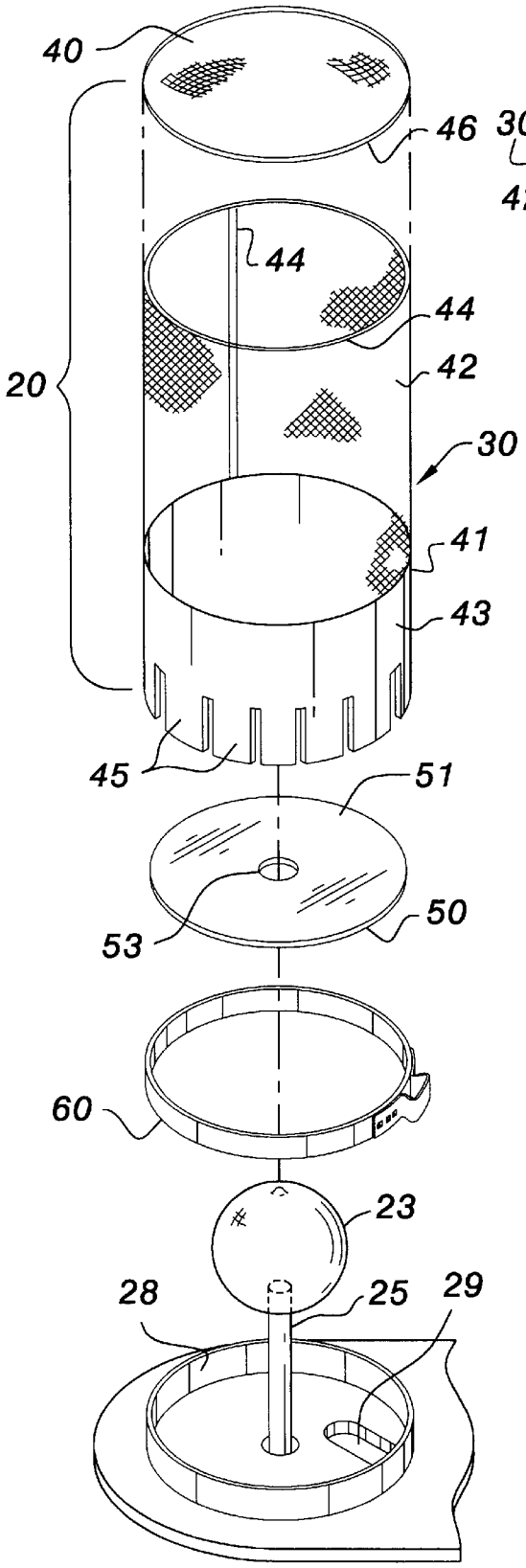
FIG. 3 is an exploded view in perspective of a portion of the screen unit of FIG. 1 showing the manner in which it attaches to the lamp assembly.

As seen in FIGS. 2 and 3, during assembly sheet 41 is rolled into a right circular cylinder such that mesh and solid sections 42 and 43 form respective adjacent cylindrical sections for the resulting screen unit 20. In order to maintain the final cylindrical form of the rolled sheet, opposite edges of the sheet are slightly overlapped, i.e., by the width of border 44, and then secured together by any suitable means such as adhesive, welding, etc. In the resulting cylinder 30, the end comprising fingers 45 defined in solid section 43 is referred to herein as the proximal end of the cylinder; the opposite end, bounded by the annular portion of border 44 of mesh section 42, is referred to herein as the distal end.

In an exemplary embodiment of the present invention, a stainless steel sheet 41 is rectangular in shape and has a thickness of 0.102 mm. The length and width of the sheet are 237.13 mm and 125.73 mm respectively. The width of solid section 43 is 41.91 mm, and the width of mesh section 42 is 83.82 mm. Edge border 44 is 1.52 mm wide. Fingers 45 are sixteen in number, extend 10.0 mm into solid section 43 from the edge of sheet 41, are separated by 1.3 mm wide slots and are 13.4 mm wide. It is to be understood that these dimensions are provided by way of example only and are not in any way limiting on the scope of the invention.

As shown in FIG. 3, end member 40 is a substantially circular mesh member formed from the same material and by the same process as cylindrical member 30. The mesh end member 40 is circumferentially bounded by a solid border 46. Border 46 and the annular portion of border 44 of cylinder 30 are joined together by crimping, welding or other suitable technique to provide a mesh closure at the distal end of the cylinder.

Figure 4:
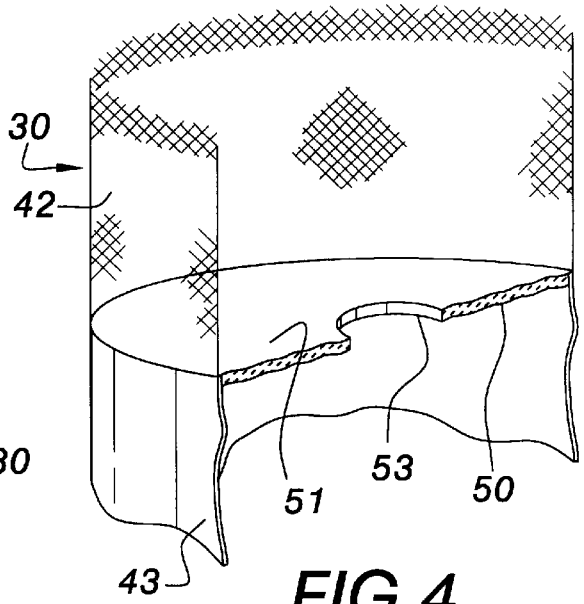
FIG. 4 is a broken detailed view in perspective of a portion of the screen assembly of FIG. 3 showing a reflector secured in the screen assembly.

As best illustrated in FIGS. 3 and 4, a reflector 50 takes the form of a circular disk having an outside diameter substantially equal to the inside diameter of cylindrical member 30. Reflector 50 is typically made from fused silica and has at least one surface 51 with an optically reflective metal oxide coating which does not absorb microwave energy. A small centrally located aperture 53 is defined in disk 50 and is of sufficient size to permit stem 25 of the bulb 21 to pass therethrough (as shown in FIG. 3). Reflector 50 is positioned coaxially within the microwave cavity at a location corresponding to the annular juncture of mesh section 42 and solid section 43. In this manner reflector 50 effectively defines an optically isolated light transmission chamber by optically closing off the proximal end of mesh section 42 from the remainder of the microwave cavity without affecting the quasi-resonant characteristics of the overall cavity at the operating microwave frequency. Attachment of reflector 50 to the cylinder is achieved by placing high temperature ceramic cement (e.g., Saurereisin™ bond cement) at plural locations around the edges of the disk where it contacts screen unit 20.

The screen unit is secured to the lamp assembly 10 (see FIGS. 1 and 3) by disposing fingers 45 circumferentially about an annular flange 28 extending from the assembly housing. The compliance inherent in the finger structure facilitates this placement. An annular hose clamp 60 (FIG. 3) may then be placed circumferentially about the fingers and then tightened by radial contraction to secure the fingers to the flange 28. Coupling slot 29 from the waveguide is located radially inward of flange 28 so that the microwave energy from magnetron 11 can be delivered into the microwave cavity defined by screen unit 20 as seen in FIG. 1.

As best seen in FIG. 1, in the assembled unit the bulb discharge envelope 23 is disposed in the optically isolated optical transmission chamber of the microwave cavity defined circumferentially by cylindrical mesh section 42 and at its ends by reflector 50 and end cap 40. Bulb stem 25 extends through aperture 53 in reflector 50 into the opaque chamber bounded by solid section 43, and then through a suitably provided bore in the lamp assembly housing where the stem is engaged by a rotatable drive shaft of motor 15 to permit rotation of the bulb about the stem axis. As is conventional, one of the effects produced by rotation of the bulb in this manner is the cooling of the bulb discharge envelope 23 in the microwave cavity.

Microwave energy entering the cavity defined by screen unit 20 via coupling slot 29 excites the fill in discharge envelope 23 resulting in light energy being emitted from the envelope. Reflective surface 51 prevents the light from entering the region of the microwave cavity bounded by solid section 43 of the cylindrical member 30. Instead, light impinging upon surface 51 is reflected out of the cavity through the interstices in mesh section 42 and end cap 40. Reflector 50, and in particular reflective surface 51, may be contoured as desired (e.g., concave, convex, etc.) to reflect light in preferential directions through the mesh. Clearly, substantially all of the light energy is prevented from passing into the region bounded by the solid section of the cylinder, thereby permitting the light to be most efficiently transmitted out through the interstices of the mesh material. Since the portions of the microwave cavity boundary wall through which light transmission is not desired are solid, the overall RF leakage through the screen unit is greatly reduced from that of an all mesh screen unit.

Figure 6:
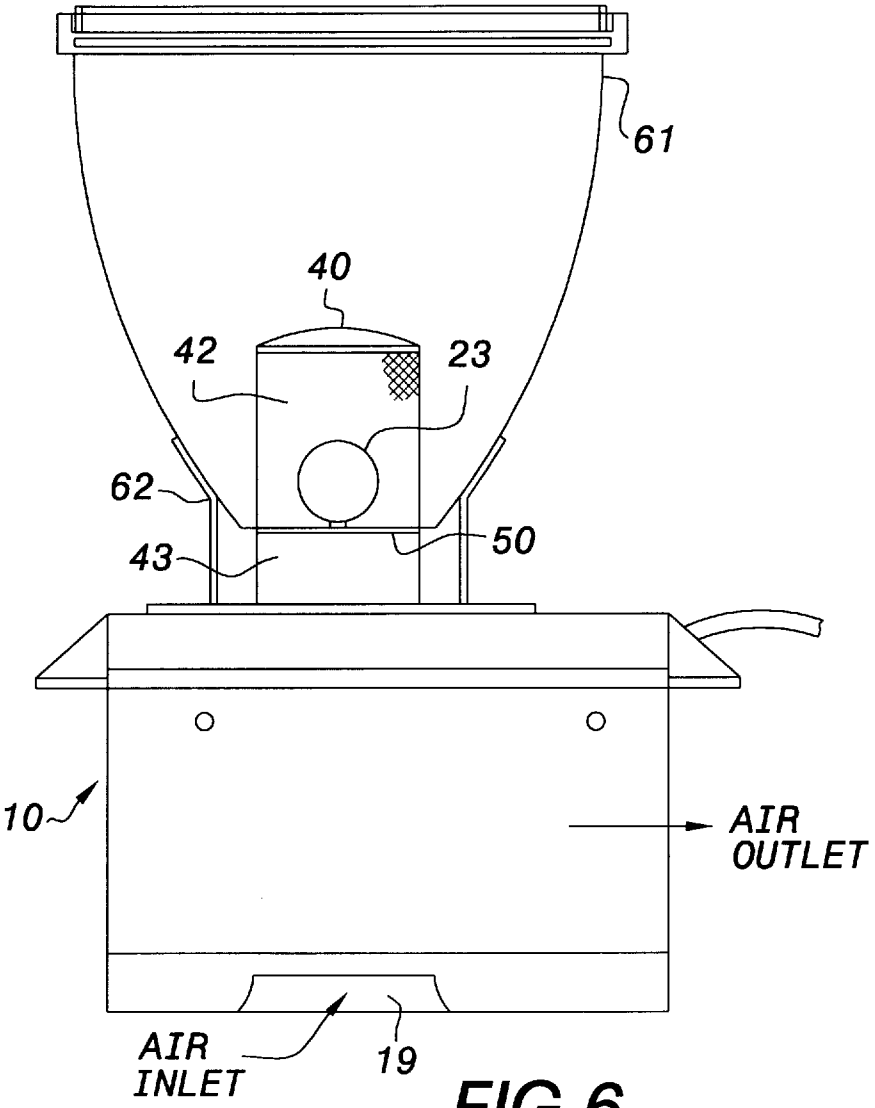
FIG. 6 is a side view in elevation of the lamp assembly of FIG. 1 shown with a reflector module attached thereto.

The lamp assembly described above may be utilized with an external reflector for focusing the light emitted through screen unit 20. Referring to FIG. 6, the assembly of FIGS. 1–5 is shown fitted with a substantially parabolic reflector 61 mounted on the lamp assembly by means of a bracket 62. Reflector 61 is positioned about mesh screen section 42 such that the bulb envelope 23 is disposed at or near the reflector focal point. The narrow end of reflector 61 is substantially co-planar with internal reflector 50 of the microwave cavity. The wide end of the reflector may be covered with a suitable glass cover.

Figure 7:
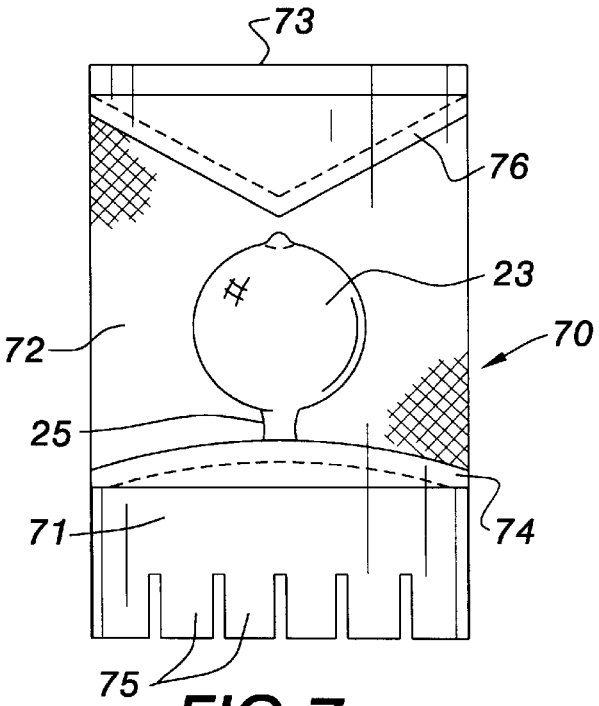
FIG. 7 is a side view in elevation of an alternative configuration of the screen assembly of the present invention.

As noted above, the cylindrical member of the screen unit is preferably fabricated by selectively etching the desired mesh pattern in a sheet of metal. It will be appreciated that the mesh pattern can easily take any shape consistent with the desired light transmission pattern for the lamp assembly. An example of another cylindrical member for a screen unit 70 formed in this manner is illustrated in FIG. 7. In this unit there are two solid metal sections, namely proximal cylindrical solid section 71, in which compliant attachment fingers 75 are formed, and a distal cylindrical solid section 73. Intermediate the two solid sections is a cylindrical mesh section 72. A proximate reflector 74 is secured at the juncture between proximal solid section 71 and mesh section 72 and has a domed convex reflective surface facing the optical transmission chamber in which the bulb discharge envelope 23 is located. A distal reflector 76 is secured at the juncture between distal solid section 73 and mesh section 72. Distal reflector 76 has a generally conical reflective surface converging toward the discharge envelope 23. Accordingly, all light emanating from the assembly is directed through the mesh section 72 of the screen unit closed by reflectors at its ends, and no mesh end cap is required. Such end cap (not illustrated) therefore may be solid and made from the same material as solid sections 71 and 73 of the cylinder.

An important advantage of the present invention is that it permits the entire assembly of FIG. 1 to be used interchangeably with screens of different configuration to produce a variety of illumination patterns. More specifically, and by way of example only, the screen unit in FIGS. 2–5 can be replaced with the unit of FIG. 7. The advantage of this is that the screen is extremely inexpensive to manufacture as compared to the other components of the assembly.

It will be appreciated, therefore, that the cylindrical member 30 can be etched or otherwise formed with any combination of mesh and solid sections from one sheet of metal. By appropriately locating one or more reflectors in the resulting microwave cavity, the optically transmissive chamber of the cavity can be isolated from the remainder of the cavity, thereby minimizing RF leakage while optimizing light transmission.

Although the screen unit for the preferred embodiments illustrated herein includes a substantially cylindrical member, it will be appreciated that the microwave cavity, in some instances, need not be cylindrical. In this regard, the same techniques described hereinabove may be utilized to provide screen units having rectangular, polygonal, oval, or other transverse cross-sections.

It will also be appreciated that the resulting screen unit of the present invention is very inexpensive to manufacture. Accordingly, if different optical configurations are required for a product line, the same overall lamp module assembly 10 may be utilized with a different screen unit in which the mesh and solid sections are oriented to yield the desired emitted light pattern.

The present invention also eliminates the requirement of fabricating a screen with an attached metal ring to secure the screen to the lamp assembly. The compliant fingers provided in the screen unit of the present invention, in combination with the hose clamp arrangement, obviates the need for the prior art permanent ring (an expensive step in screen fabrication) and allows for rapid, easy attachment of the screen unit to the lamp assembly.

The screen unit of the present invention allows for a multitude of solutions for moving and removing heat from the bulb and optics of the system. For example, by pressurizing the volume at the proximal end of the screen unit (i.e., defined by the reflector, the solid portion of the screen unit and the waveguide), one may introduce a flow of air to the bulb for cooling purposes. One may also derive a alternative ways of utilizing this enclosed volume as a plenum to deliver air to parts requiring cooling. Still further, the continuous portions of the screen may be treated to absorb and radiate efficiently, allowing for heat transfer from the optics internal to the cavity to the outside environment.

In order to enhance the optical and/or microwave characteristics of the lamp, it is possible to coat or plate the mesh and the solid portions of the screen unit. These same coatings may be difficult or cost prohibitive if applied to the waveguide.

From the foregoing description it will be appreciated that the invention makes available a novel screen unit for electrodeless lamps wherein mesh and solid sections may be defined in a single member used to form the body of a microwave cavity, and wherein a reflector can be disposed at the juncture between the solid and mesh sections to optically isolate those sections to achieve improved light transmission while reducing microwave energy leakage from the cavity.

Having described preferred embodiments of a new and improved microwave containment screen for electrodeless discharge lamps, it is believed that other modifications, variations and changes will be suggested to persons skilled in the art in view of the teachings set forth herein. Accordingly, it is to be understood that all such variations, modifications and changes are believed to fall within the scope of the present invention as defined by the appended claims.

What is claimed is:

1. A microwave powered lamp comprising:

a source of microwave energy;

a microwave cavity having a one-piece peripheral boundary wall including a solid wall section substantially impervious to light and to said microwave energy, and a mesh wall section transmissive to light and not transmissive to said microwave energy;

an electrically non-conductive light reflector mounted within said cavity to subdivide said cavity into first and second chambers, said first chamber including said solid section of said peripheral boundary wall, said second chamber including at least part of said mesh section of said peripheral boundary wall, wherein said reflector optically isolates said second chamber and blocks light transmission between said chambers;

a discharge envelope containing material therein excitable by said microwave energy to emit light therefrom, said discharge envelope being maintained in said second chamber such that said light emitted from said envelope is transmitted through said mesh section both directly from said envelope and as reflected light from said reflector; and coupling means directing said microwave energy from said source into said cavity to excite said material in said discharge envelope.

2. The lamp of claim 1 further comprising a drive motor for rotating said discharge envelope, wherein said discharge envelope is supported on a stem extending through said reflector, into and through said first chamber, and into rotatable engagement with said motor.

3. The lamp of claim 1 wherein said coupling means comprises a waveguide unit and a coupling slot disposed in a housing, said housing having a flange projecting outward from the housing and circumscribing said coupling slot;

wherein said microwave cavity is secured to said housing at said flange by plural compliant circumferentially spaced fingers projecting from said solid section and disposed about said flange, and a hose clamp compressing said fingers against said flange.

4. The lamp of claim 1 wherein said peripheral boundary wall is a one-piece sheet of metal through which said mesh section is defined over a prescribed area.

5. The lamp of claim 4 wherein said mesh section comprises multiple interstitial openings in said sheet.

6. The lamp of claim 5 wherein said solid and mesh sections comprise adjacent cylindrical sections, wherein said coupling means communicates directly with said first chamber of said cavity to direct said microwave energy into said first chamber.

7. The lamp of claim 6 wherein said mesh section is bounded by a narrow solid metal border, said border comprising a continuance of the solid section, and wherein said sheet is disposed about an axis to provide said peripheral boundary wall as a cylinder with said border along opposite edges of said sheet in overlapping and joined relation.

8. The lamp of claim 1, further comprising an external reflector positioned about said mesh wall section, for focusing said light transmitted through said mesh wall section.

9. A microwave powered lamp comprising:

a source of microwave energy;

a microwave cavity having a boundary wall including a single metal sheet having a solid optically non-transmissive wall section and a mesh wall section defined therein;

coupling means for delivering said microwave energy to said cavity;

a discharge envelope mounted in said cavity and containing fill material therein responsive to excitation by said microwave energy for emitting light from said envelope; and an electrically non-conductive reflector mounted in said cavity for defining an optically isolated light-transmitting chamber in said cavity wherein said reflector is positioned to reflect said light from said envelope into said chamber and out through said mesh wall section.

10. The lamp of claim 9 wherein said sheet has multiple compliant fingers defined in spaced relation along one edge thereof for securing said cavity to said coupling means.

11. The lamp of claim 9 wherein said mesh and solid wall sections meet at a juncture, and wherein said reflector is secured at said juncture to define said light-transmitting chamber between said mesh section and said reflector, leaving a remainder of said cavity bounded by the optically non-transmissive solid wall section and said reflector.

12. A method for constructing a microwave powered electrodeless lamp of the type having a discharge envelope disposed in a microwave cavity and containing fill material therein responsive to microwave energy for emitting light therefrom, said method comprising the steps of:

(a) forming a mesh pattern through part of a thin metal sheet to define adjacent mesh and solid sections in said sheet with a juncture between said sections;

(b) securing opposite edges of said sheet to one another to form a peripheral enclosure for said cavity;

(c) securing an electrically non-conductive light reflector in said cavity and proximate to an optical transmission chamber bounded at least in part by said reflector and said mesh section; and (d) disposing said discharge envelope in said optical transmission chamber.

13. The method of claim 12 further comprising the steps of:

(e) securing said cavity to a waveguide assembly of said lamp by forming multiple compliant fingers along one edge of said sheet as part of step (a);

(f) disposing the compliant fingers about a continuous flange on said waveguide assembly; and (g) radially constricting said fingers about said flange with a clamp.

14. The method of claim 12 further comprising the step of:

(e) securing said cavity to a waveguide assembly of said lamp.

15. The method of claim 14 further comprising the steps of:

(f) removing from said waveguide assembly the cavity secured thereto in step (e); and (g) securing a second cavity to said waveguide assembly.

16. The method of claim 12 wherein step (a) includes etching said mesh pattern through said sheet.

17. A method for constructing a microwave powered electrodeless lamp of the type having a discharge envelope disposed in a microwave cavity of a lamp assembly and containing fill material therein responsive to microwave energy for emitting light therefrom, said method comprising the steps of:

(a) forming a mesh pattern through part of a one-piece metal sheet to define adjacent mesh and solid sections in said sheet with a juncture between said sections;

(b) forming a peripheral screen unit with said sheet;

(c) securing said screen unit to the lamp assembly to form an enclosure; and (d) disposing the discharge envelope in said enclosure.

18. A microwave powered lamp comprising:

a source of microwave energy;

a microwave cavity having a one-piece sheet boundary wall including a solid wall section substantially impervious to light and to said microwave energy, and a mesh wall section transmissive to light and not transmissive to said microwave energy;

a discharge envelope containing material therein excitable by said microwave energy to emit light therefrom, said discharge envelope being maintained in said cavity such that said light emitted from said envelope is transmitted through said mesh section;

coupling means directing said microwave energy from said source into said cavity to excite said material in said discharge envelope; and wherein said mesh section comprises multiple interstitial openings in said sheet.

19. A microwave cavity for an electrodeless lamp, said cavity comprising:

a one-piece peripheral boundary wall including a solid wall section substantially impervious to light and to microwave energy, and a mesh wall section transmissive to light and not transmissive to said microwave energy.

20. A method of constructing a microwave cavity, comprising the steps of:

(a) forming a mesh pattern through part of a thin metal sheet to define adjacent mesh and solid sections in said sheet with a juncture between said sections; and (b) securing opposite edges of said sheet to one another to form a peripheral enclosure defining said cavity.

* * * * *

UNITED STATES PATENT AND TRADEMARK OFFICE

CERTIFICATE OF CORRECTION

PATENT NO : 5,811,936

DATED : September 22, 1998

INVENTOR(S): TURNER, Brian P., et al.

It is certified that error appears in the above-identified patent and that said Letters Patent are hereby corrected as shown below:

Column 1, after the Title insert the following new paragraph:

-- This invention was made with Government support under Contract No. DE-FG01-95EE23796 awarded by the Department of Energy. The Government has certain rights in this invention.--

Signed and Sealed this

Twelfth Day of January, 1999

*Attest:*

*Attesting Officer*

*Acting Commissioner of Patents and Trademarks*